United States Patent [19]

Schoffl

[11] Patent Number: 4,979,444

[45] Date of Patent: Dec. 25, 1990

[54] MINE, PARTICULARLY A LAND MINE

[75] Inventor: Rainer Schoffl, Odenthal-Erberich, Fed. Rep. of Germany

[73] Assignee: Dynamit Nobel Aktiengesellschaft, Troisdorf, Fed. Rep. of Germany

[21] Appl. No.: 454,918

[22] Filed: Dec. 22, 1989

[30] Foreign Application Priority Data

Dec. 24, 1988 [DE] Fed. Rep. of Germany ..... 3843899
Oct. 28, 1989 [DE] Fed. Rep. of Germany ..... 3936065

[51] Int. Cl.[5] ..... F42B 23/00

[52] U.S. Cl. ..... 102/404; 102/384; 102/401

[58] Field of Search ..... 102/401, 404, 384

[56] References Cited

U.S. PATENT DOCUMENTS

| | | | |
|---|---|---|---|
| 3,403,624 | 10/1968 | Fosler et al. | 102/404 |
| 3,831,521 | 8/1974 | Engeli | 102/404 |
| 3,868,905 | 3/1975 | Ragailler | 102/404 |
| 3,994,227 | 11/1975 | Harvey | 102/404 |
| 4,919,051 | 4/1990 | Cohen | 102/404 |

FOREIGN PATENT DOCUMENTS 3515497 10/1986 Fed. Rep. of Germany .

2174482 11/1986 United Kingdom .

*Primary Examiner*—Charles T. Jordan
*Assistant Examiner*—Rochelle Lieberman
*Attorney, Agent, or Firm*—Antonelli, Terry, Stout & Kraus

[57] ABSTRACT

A mine, particularly a land mine, is equipped with at least one active (i.e. destructive) element which is accommodated in a housing of the mine and can be brought to the functional level by means of a rocket engine. For attaining a definite ascent of the active element, the rocket engine is mounted to this active element in such a way, and is designed in such a way, that its exhaust nozzles are located outside the mine housing and the propellant gases of the rocket engine effect extraction of the active element from the mine housing which is open at an upper end. The rocket engine furthermore exerts preferably a torque on the active element about the longitudinal axis of the element so that, in conjunction with an effective charge, the effective direction of which is inclined obliquely downwardly, the effective area on the ground continuously increases in a spiral fashion during ascent of the active element.

10 Claims, 3 Drawing Sheets

MINE, PARTICULARLY A LAND MINE

The invention relates to a mine, particularly a land mine, of the type having an active element which is accommodated within a housing of the mine which can be raised to a functional level, i.e. combat stage, by a rocket engine.

The effective radius and the efficacy of a mine, particularly a land mine, but also e.g. of a sea mine, can be considerably improved by providing that this mine fires one or several active elements in a downward direction; these elements then act against the target object to be combated from above downwardly. Such a mine has been disclosed, for example, in DOS No. 2,509,705 wherein an accelerating means is provided in order to bring the active element or elements to its or their functional level. This accelerating means can selectively be a cartridge or a rocket engine.

Depending on the mass of the active element to be accelerated and on its desired functioning level above the respective ground level and on the flight time to that location, a propellant cartridge will exert a more or less vigorous recoil on the mine housing; with a lack of steadiness of the mine or in case of a soft ground surface, this can lead to tilting of the mine housing. The consequence thereof is a flight path of the active element that deviates more or less extensively from the desired flight route and thereby impairs or even precludes functioning of the active element.

Considerable recoil forces also arise when using a rocket engine as the accelerating means since, in accordance with DOS No. 2,509,705, the rocket engine is located within the mine housing which acts as a starting device entirely sealed at the rear, i.e. in this case "at the bottom" and along the side.

The invention is based on the object of avoiding the aforementioned disadvantages, i.e. of fashioning the mine so that the at least one active element can be flawlessly deployed at the functional height.

This object has been attained, for a mine in accordance with the present invention, by a structure wherein the rocket engine is mounted to the active element so that the exhaust nozzles or the engine are located outside or away from the mine housing and the propellant gases discharged from these nozzles effect removal of the active element from the mine housing. The object is advantageously attained in that the active element is pulled out practically without recoil from the upwardly open mine housing and brought to its respective functional level.

The rocket engine herein is preferably arranged at the zone of an upper end of the active element. In this arrangement, the rocket engine is either provided around the active element or it is fastened, i.e. attached, to its upper end, i.e. the end facing away from the ground.

Depending upon the form and size of the mine housing and the active element arranged therein, a structure wherein exhaust nozzles of the rocket engine are arranged to extend obliquely at an angle in a radial direction from the center of the engine and/or active element, proves to be advantageous whereby it is made possible to additionally reduce to an utmost extent also the proportion of rocket propellant gases impinging on the mine housing from the outside.

An especially advantageous further development of the invention is provided wherein the rocket engine is located within the outer contour of the mine housing. It is thus made possible, with given external dimensions, to optimally utilize the "mine volume" available because the mine housing does not have to be designed with external dimensions that are smaller as compared with the rocket engine. The mine housing and the casing of the rocket engine are preferably designed as circular cylinders having the same outer diameter. The free space for the unimpeded exhausting of the propellant gases from the exhaust nozzles of the rocket engine, which nozzles are arranged at an angle, is preferably fashioned as a conical, annularly extending recess.

The rocket engine requires several exhaust nozzles, but at least two, in that the danger of thrust asymmetries on account of manufacturing tolerances exists. In order to keep the effect of such thrust asymmetries at a minimum, the exhaust nozzles of the rocket engine are oriented to extend preferably tangentially inclined so that they bring about a rotation of the active element. Advantageously, the number of revolutions thus attainable is chosen so that it serves simultaneously for the flight stabilization of the active element.

Insofar as sensors reactive to heat radiation are arranged in the active element for triggering the action of the active element, for example a projectile-creating charge, then the rocket engine must have been shut down at the point in time when the sensors become operative. Therefore, the burning time of the propellant charge for the rocket engine must be selected to be as brief as possible, preferably less than 0.5 sec. By the use of a low-residue solid grain, for example, a double-base propellant charge, or at least a solid propellant charge with low smoke evolution, an additional impairment of correspondingly sensitive sensors due to smoke is likewise avoided. Furthermore, a solid propellant charge that leaves little traces has the advantage that the start of the active element is difficult to detect and thus the target object to be combated is not afforded any possibilities for taking counter-measures.

An especially advantageous embodiment is possible by the use of an active element, the effective direction of which is not congruent with the longitudinal axis of the active element housing and/or the mine housing or mine body but, rather, is arranged to be obliquely inclined thereto. In conjunction with the generation of a rotation by the rocket engine, the objective is thereby achieved that the active area on the ground is advantageously enlarged in spiral fashion with an increasing level of ascent of the active element.

The invention is illustrated by the embodiments shown in the accompanying drawings and will be described in greater detail with reference thereto. In the drawings, which are, respectively, schematic and longitudinal sectional views.

Figure 1:
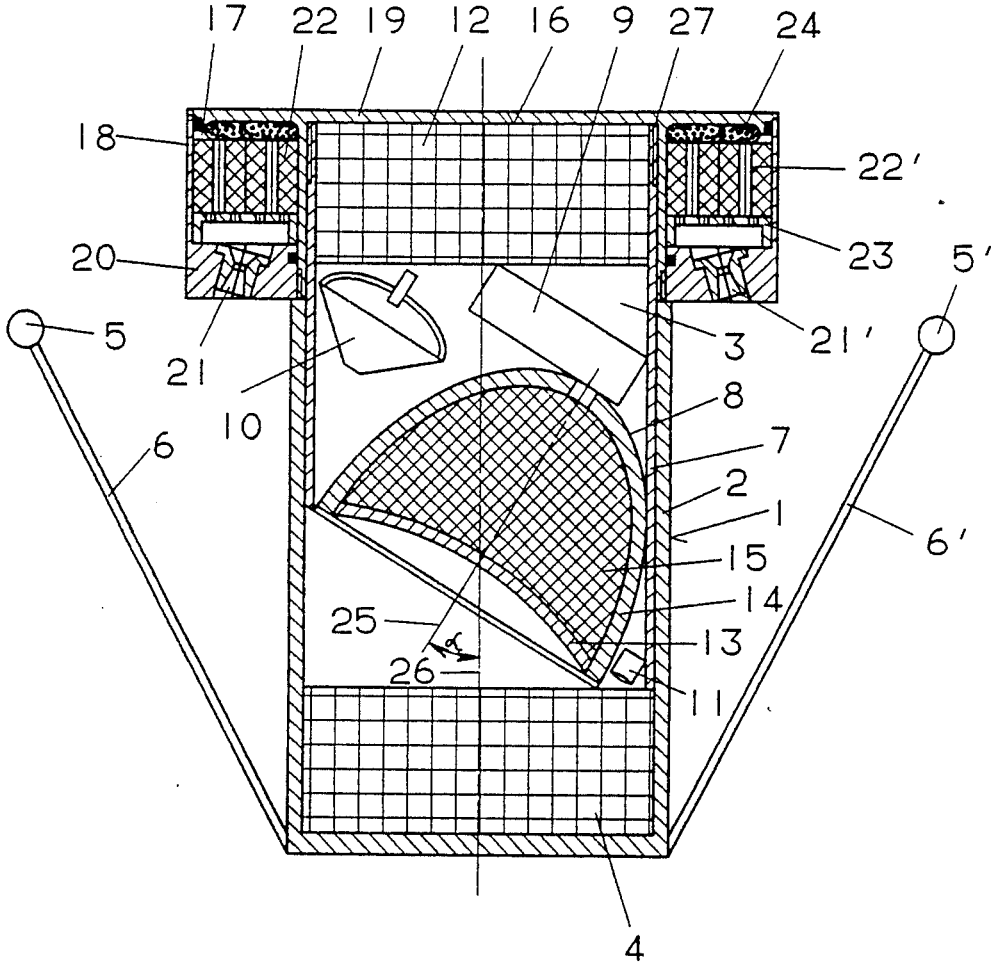
FIG. 1 is a view of a land mine ready for deployment.

FIG. 1 shows a schematic longitudinal sectional view of a cylindrical mine 1, an active element 3 and an electronic system 4 being arranged in the housing 2 of the mine, made of steel, for example. The mine housing 2 is cylindrical, sealed at its bottom end by a cover, and fashioned to be open at the top end. As the locating sensors of the mine, the two microphones 5, 5' are provided, for example, which are secured to the housing and mounted to upwardly projecting rods 6, 6'. These rods are conventionally collapsed in the manner of a telescope in the storage and transport condition of the mine and are folded against the housing. The signals received by the microphones 5, 5', which, in the functional condition of the mine 1, are conventionally extended and unfolded, are evaluated in the electronic circuit 4 which triggers the start, i.e. left off, of the active element 3 with an appropriate target position of an object to be combated.

The active element 3 comprises a housing 7 of, for example, a synthetic resin and accommodating an effective explosive-containing charge 8, a safety and, respectively, an arming device 9, as well as respectively one radar sensor 10 and one infrared sensor 11. The effective charge 8 is in this case fashioned as a projectile-forming charge and conventionally comprises an insert 13, a jacket 14, and an explosive charge 15. However, the effective charge could also be designed in a different way, for example, in the form of subsidiary projectiles to be fired from the active element, or dispersed in some other known manner. The effective charge 8 is arranged within the housing 7 of the active element 3 in such a way that its longitudinal axis 25 is tilted by the angle $\alpha$ with respect to the longitudinal axis 26 of the housing 7 so that the destructive action of the effective charge is directed obliquely downwardly.

The two sensors 10 and 11 are aligned with their axes of symmetry on their longitudinal axes essentially in parallel to the axis of symmetry or longitudinal axis 25 of the effective charge 8. Furthermore, an electronic circuit 12 is located in the housing 7 of the active element 3, also comprising an energy supply, not shown herein, for example a battery.

The rocket engine 17 designed as an annular casing 18 with a bottom or wall support 19 and a nozzle plate 20 is arranged around the top end 16 of the active element. The rocket engine 17 is connected to the housing 7 of the active element 3, for example, by way of a threaded connection 27; by caulking, cementing, or the like, of the threaded connection, for example, it is to be ensured that in case of a rotation-generating rocket engine, the engine is not detached from the housing of the active element 3 during the flight phase of the element 3. Several nozzles 21, 21' are countersunk into the nozzle plate 20. Several tubules 22, 22' of solid propellant, filling the casing 18, constitute in a conventional way the propellant charge of the rocket engine 17. The tubules 22, 22' rest on the perforated disk 23 and are ignited by the igniter charge 24.

In case the electronic system 4 has recognized and localized a target object based on the signals received by the microphones 5, 5', the electronic circuit 12 of the active element 3 is activated, and the rocket engine 17 is ignited. The upwardly directed thrust of the rocket engine 17 pulls the active element 3 out of the "tank-shaped" mine housing 2 open at the top end, in the upward direction.

Figure 2:
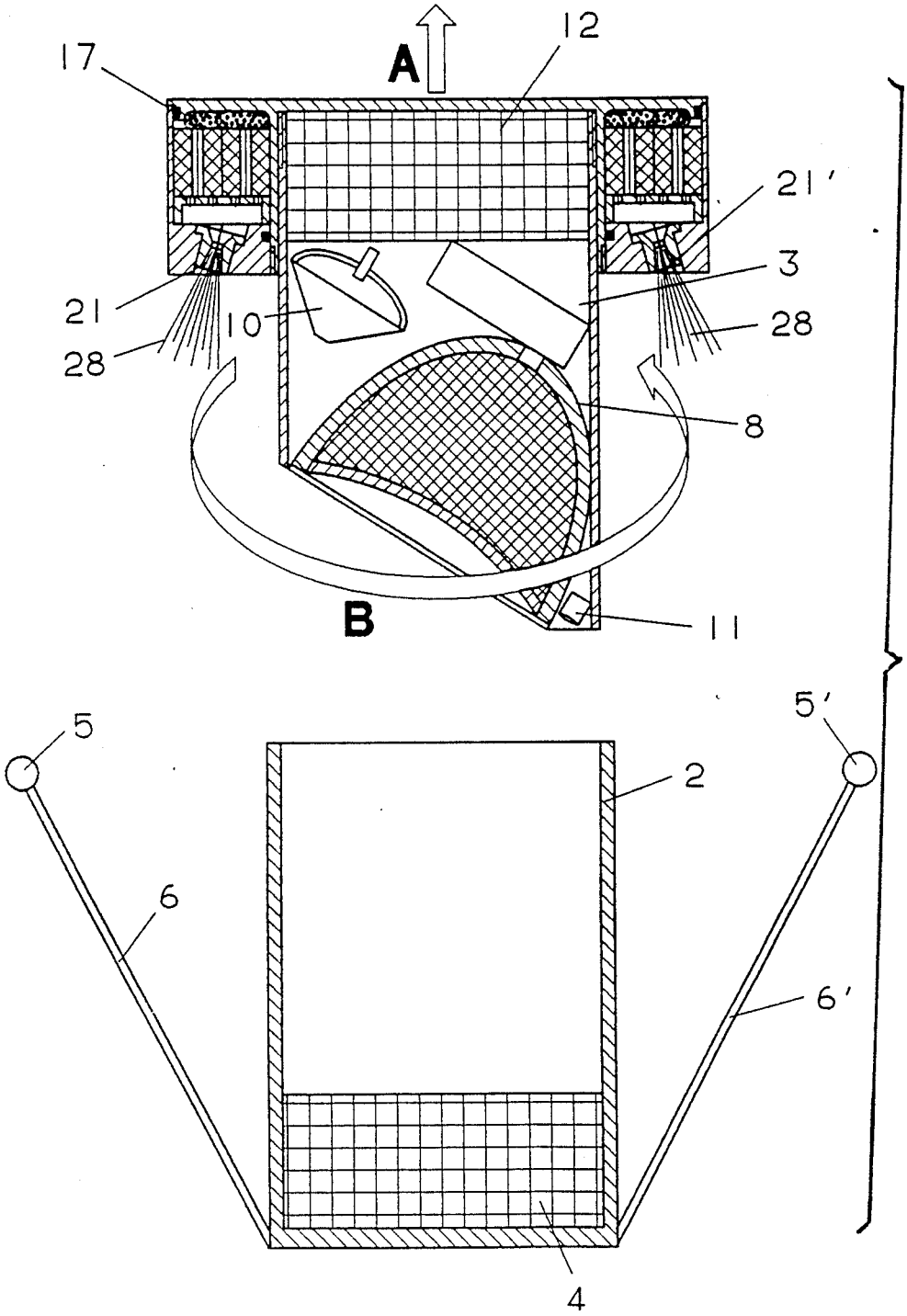
FIG. 2 shows a view of the mine according to FIG. 1 during deployment.

FIG. 2 shows the thus-described function of the mine. While the housing 2 with electronic system 4 and microphone rods 6, 6' remains on the ground, the active element 3 ascends under the tractive force of the rocket engine 17 in correspondence with the effluent propellant gases 28. Due to a tangential orientation of the nozzles 21, 21', not illustrated in the drawing on account of the drafting technique, the active element 3 is simultaneously set into rotation about axis 26. The two directions of movement, ascent and rotation, are indicated by the arrows A and B. On account of the rotational and ascending motion, the axes of symmetry of the effective charge 8 and the sensors 10 and 11, extended to a basal surface, preferably the ground, describe a constantly enlarging spiral. As soon as the target object to be combated is swept by the spiral, the electronic circuit 12 triggers the effective charge 8 based on the signals of sensors 10 and 11 and the destructive action of projectile-forming charge directed onto the target object.

Figure 3:
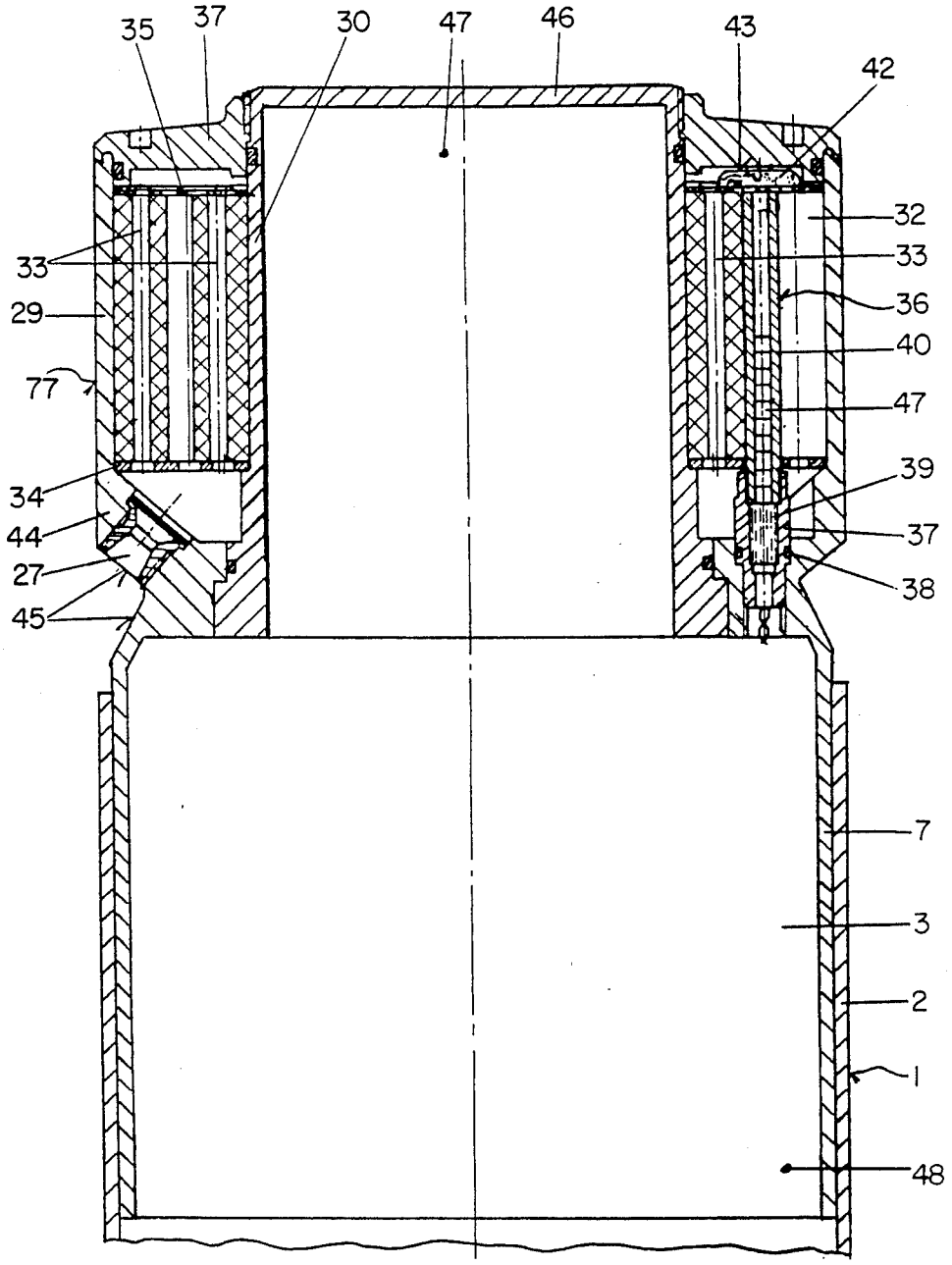
FIG. 3 shows a modification of the land mine according to FIG. 1 in a fragmentary view.

In the modified embodiment shown in FIG. 3, the cylindrical housing 2 of the mine 1 exhibits, as contrasted to the mine illustrated in FIG. 1, the same external dimensions, i.e. the same external diameter as the jacket 29 of the rocket engine 17, but the housing could also optionally be larger. This ensures that ——as seen in top view—— the rocket engine 17 is arranged within the contour of the mine housing 2; this includes the preferred borderline case that the outer contour of the rocket engine 17 is congruent with that of the mine housing 2.

The rocket engine 17 comprises the outer, circular-cylindrical jacket 29 and the inner circular-cylindrical jacket 30, as well as the substantially circular-ring-shaped bottom 31. The two jackets 29 and 30 constitute an annular combustion chamber 32 wherein the propellant charge tubules 33 are conventionally located. These tubules are positioned in the downward direction on the perforated ring 34 and are covered on their upper ends by the perforated ring 35.

An igniter 36 is provided for igniting the propellant charge tubules 33. An electrical igniter means 39 is arranged in the screw 37 of the igniter with sealing ring 38. A tubular extension 40 is threaded into the screw 37 and extends up to the top cover ring 35; this extension is filled with press-molded elements 41 made of an initiating mixture, such as black powder, for example. For reinforcing the flame of the press-molded elements 41, an additional powder charge 42 is provided which is arranged in the thin-walled plastic bag 43 between the cover ring 35 and the bottom 31, the flame spreading from there in a known way in the combustion chamber 32 and effecting ignition of all propellant charge tubes 33.

The jacket 29 is in this arrangement fashioned to be integral with the wall of the housing 7 of the active element 3. In the bottom zone of the rocket engine 17, the jacket 29 is provided with the bead 44 to accommodate the exhaust nozzles 21 —— of which only one is illustrated. For ensuring the free, unimpeded efflux of the propellant gases from the exhaust nozzles 21, the jacket 29 and the wall of the housing 7 are equipped with the annular conical recess or construction 45 in the zone adjoining the thickened portion 44.

The inner jacket 30 is sealed at its top end by means of the integrally formed bottom or wall support 46, and the cylindrical wall of the housing 7 of the active element 3 define the chambers 47 and 48 for receiving a payload as indicated, for example, in the embodiment of the mine illustrated in FIG. 1.

What is claimed is:

1. A mine, particularly a land mine, which comprises at least one active element which is accommodated in a housing of the mine and which can be brought to a functional level by means of a rocket engine; the rocket engine being mounted to the active element in such a way, and being constructed in such a way, that exhaust nozzles of the engine are located outside the mine housing and propellant gases flowing out of these nozzles effect extraction of the active element from the mine housing.

2. A mine according to claim 1, wherein the rocket engine is arranged in the zone of the upper end of the active element.

3. A mine according to claim 1, wherein the exhaust nozzles are arranged so that the nozzles extend obliquely at an angle in a radial direction.

4. A mine according to claim 2, wherein the exhaust nozzles are arranged so that the nozzles extend obliquely at an angle in a radial direction.

5. A mine according to claim 3, wherein the cross-sectional dimensions of the active element and of the rocket engine are adapted to each other in such a way that the rocket engine is located within the outer contour of the mine housing and that a free space is provided below the exhaust nozzles which are arranged at an angle, this space being adjoined by the mine housing.

6. A mine according to claim 1, characterized in that the exhaust nozzles are arranged to be obliquely inclined in a tangential direction.

7. A mine according to claim 1, wherein the rocket engine exhibits a burning time that is very brief as compared with the flight time of the active element.

8. A mine according to claim 1, wherein the rocket engine contains a solid propellant leaving little trace of smoke or residual gases.

9. A mine according to claim 5, wherein the active element comprises an effective charge with an obliquely downwardly directed orientation of effectiveness, as well as at least one sensor effective in parallel thereto, so that due to a combined rotational/ascending motion of the active element, an effective area for engagement with a target object is produced on the ground which increases in a spiral fashion.

10. A mine according to claim 1, wherein the rocket engine is arranged around an upper end of the active element in an annular configuration.

* * * * *